US011000941B2

(12) United States Patent
Krupsaw et al.

(10) Patent No.: US 11,000,941 B2
(45) **Date of Patent: *May 11, 2021**

(54) RECIPROCATING SAW

(71) Applicant: BLACK & DECKER, INC., New Britain, CT (US)

(72) Inventors: Benjamin Krupsaw, Baltimore, MD (US); Paul S. White, Ellicott City, MD (US); Michael Varipatis, Fallston, MD (US); Nathan J. Osborne, Baltimore, MD (US); Nicholas J. Garibaldi, Baltimore, MD (US); Christian V. Elder, Baltimore, MD (US); William F. Gallagher, Stewartstown, PA (US)

(73) Assignee: Black & Decker Inc., New Britain, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/854,224

(22) Filed: Apr. 21, 2020

(65) Prior Publication Data

US 2020/0246958 A1 Aug. 6, 2020

Related U.S. Application Data

(63) Continuation of application No. 15/628,306, filed on Jun. 20, 2017, now Pat. No. 10,625,410.

(60) Provisional application No. 62/352,237, filed on Jun. 20, 2016.

(51) Int. Cl.
*B25F 5/00* (2006.01)
*B25F 5/02* (2006.01)

(52) U.S. Cl.
CPC ..... *B25F 5/006* (2013.01); *B25F 5/02* (2013.01)

(58) Field of Classification Search
CPC ..... B25F 5/006; B25F 5/05
See application file for complete search history.

(56) References Cited

U.S. PATENT DOCUMENTS

| | | | | |
|---|---|---|---|---|
| 4,847,513 | A * | 7/1989 | Katz | B23D 47/12 30/DIG. 1 |
| 6,168,881 | B1 * | 1/2001 | Fischer | B25F 5/02 292/219 |
| 8,228,029 | B2 * | 7/2012 | Meyer | H01M 2/1066 320/112 |
| 2006/0199072 | A1 * | 9/2006 | Lui | B25F 5/02 429/97 |
| 2008/0155834 | A1 * | 7/2008 | Li | B26B 19/04 30/210 |

* cited by examiner

*Primary Examiner* — Omar Flores Sanchez
(74) *Attorney, Agent, or Firm* — Michael Aronoff

(57) ABSTRACT

The present disclosure is directed to a cordless reciprocating saw including a mechanical interface for attaching a removable battery pack. The mechanical interface includes a strike plate to reduce the effects of vibrational forces on the battery pack.

8 Claims, 20 Drawing Sheets

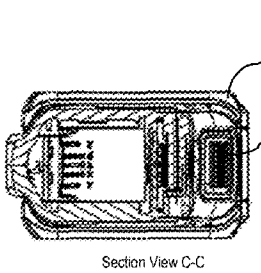
Figure 17
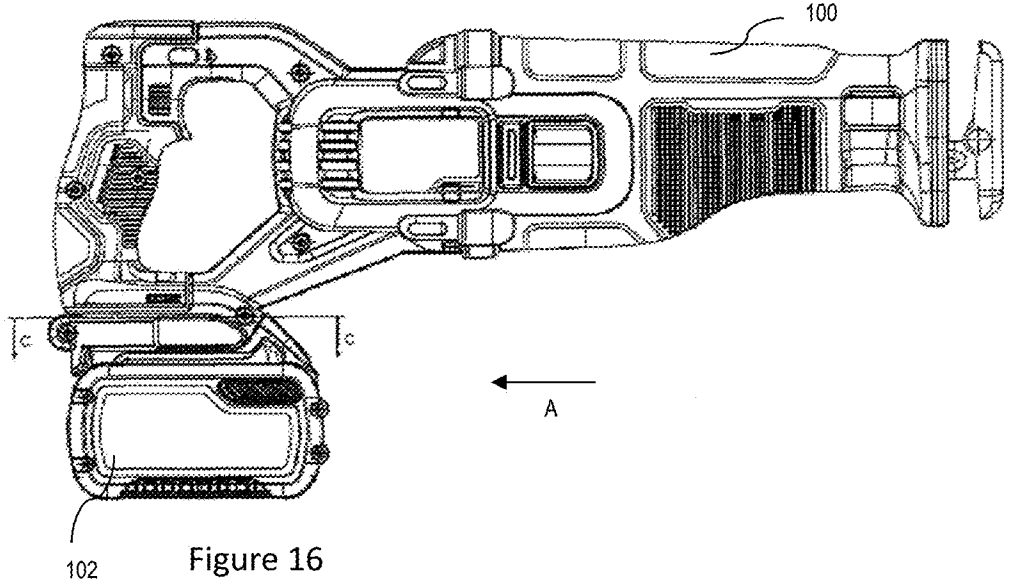
Figure 16
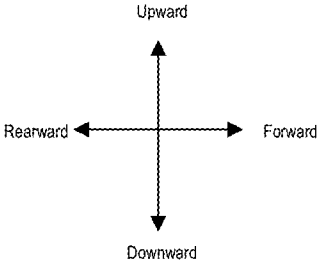

RECIPROCATING SAW

RELATED APPLICATIONS

This application is a continuation of U.S. patent Ser. No. 10/625,410, issued Apr. 21, 2020, which patent claims priority to U.S. Provisional Application No. 62/352,237, filed Jun. 20, 2016.

TECHNICAL FIELD

This application relates to a cordless reciprocating saw. In one implementation, the reciprocating saw is configured to address the effects of vibrational forces on an attached battery pack.

BACKGROUND

As is well known, reciprocating saws produce significant vibration during operation. Certain cordless reciprocating saws rely on a removable battery pack to provide power to the motor. And certain of these cordless reciprocating saws produce significant vibrational forces in the same direction or in a direction very close to the direction that the battery pack is inserted to mate with the reciprocating saw. In these reciprocating saw/battery pack combinations sustained vibrational forces may overcome the attachment feature holding the battery pack on the reciprocating saw (typically a latch and a catch combination) and cause the battery pack to be ejected from the reciprocating saw.

SUMMARY

An aspect of the present invention includes a reciprocating saw including mechanical interface for coupling a removable battery pack. The mechanical interface includes a strike plate for reducing the effects of vibrational forces on the battery pack and to prevent the battery from inadvertently detaching from the reciprocating saw during operation.

A reciprocating saw, comprising a mechanical interface for receiving a battery pack including a latch having a forward facing surface, the mechanical interface including a catch for receiving the latch, the catch including a recess having a rearward facing surface; and a strike plate including an engagement arm attached to the rearward facing surface of the recess, the engagement arm configured at an angle of 15 degrees to the latch forward facing surface when the battery pack is fully seated in the mechanical interface.

These and other advantages and features will be apparent from the description and the drawings.

BRIEF DESCRIPTION OF THE DRAWINGS

FIG. 16 is a first side view of the reciprocating saw of FIG. 1 coupled to a battery pack.

FIG. 17 is a section view along section line C-C of FIG. 16.

DETAILED DESCRIPTION

Figure 1:
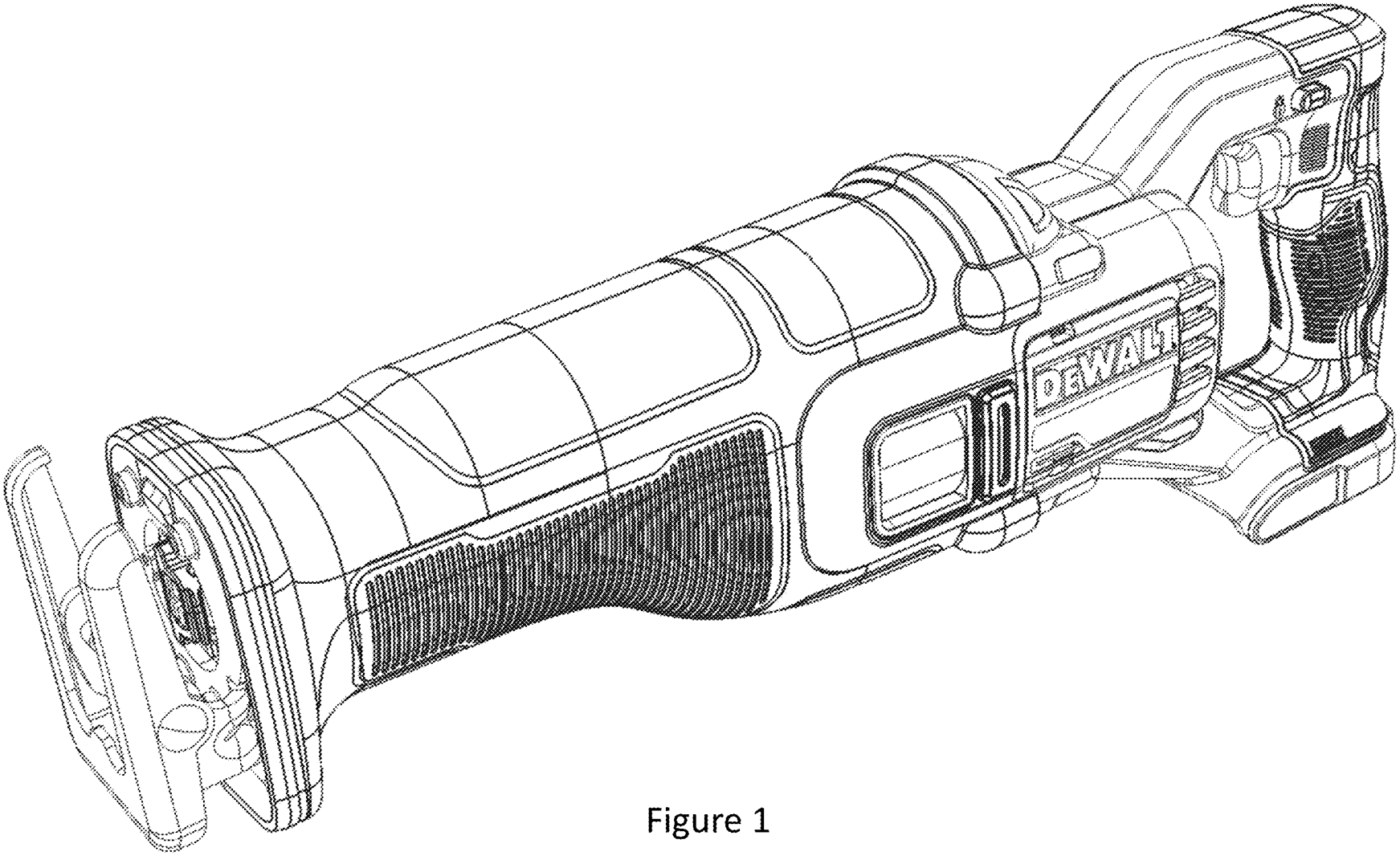
FIG. 1 is a first perspective view of a reciprocating saw of the present disclosure.
Figure 2:
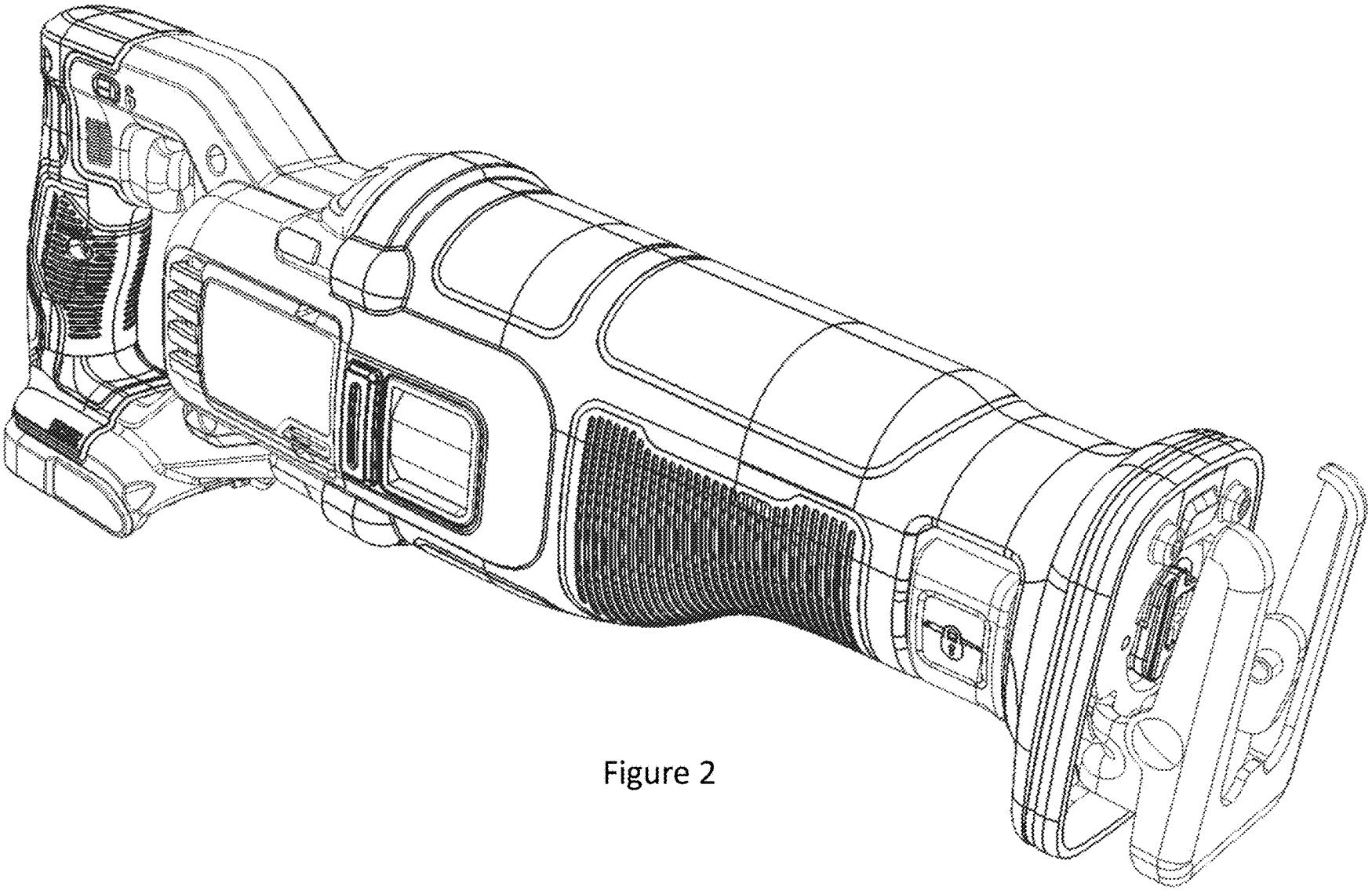
FIG. 2 is a second perspective view of the reciprocating saw of FIG. 1.
Figure 3:
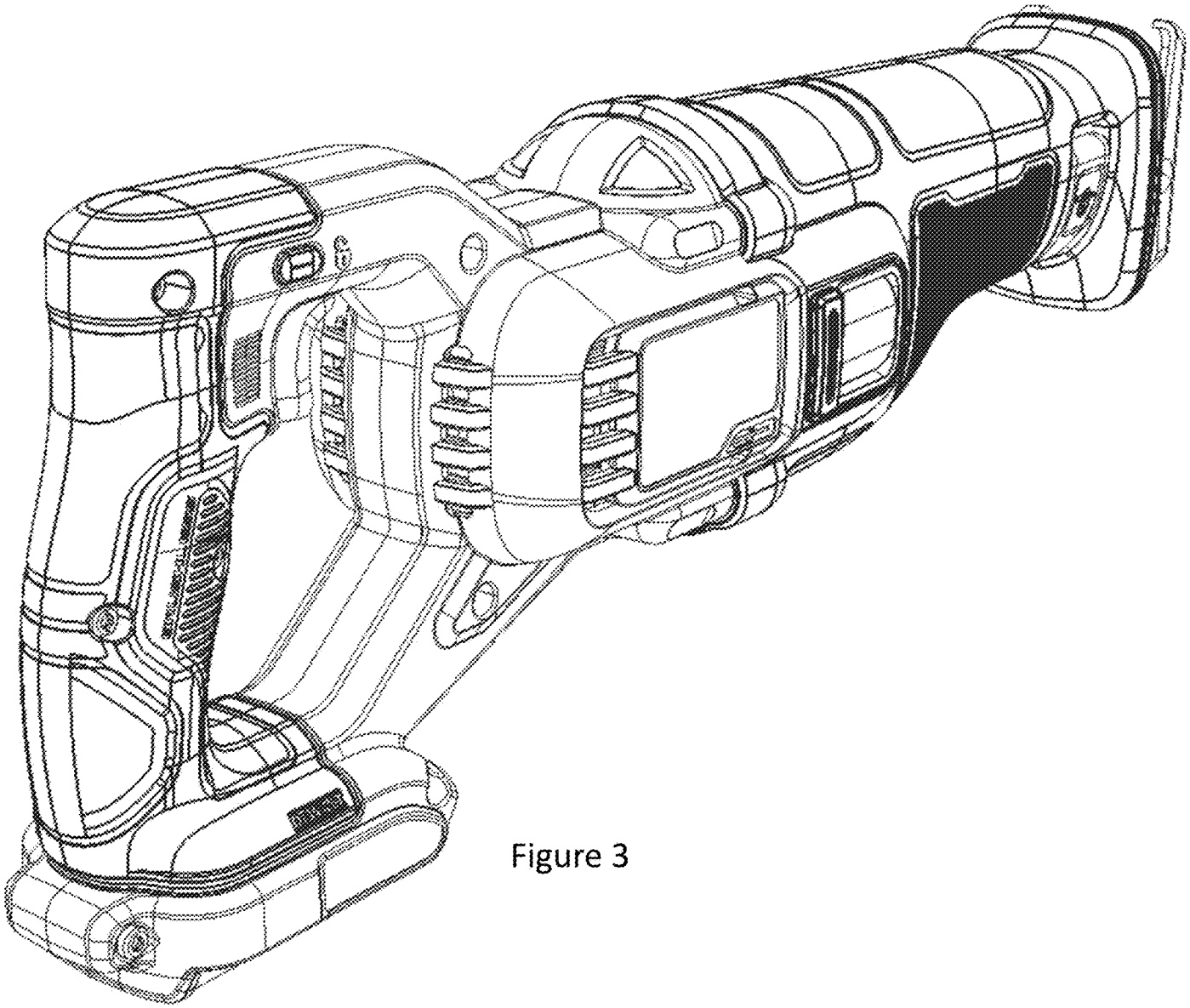
FIG. 3 is a third perspective view of the reciprocating saw of FIG. 1.
Figure 4:
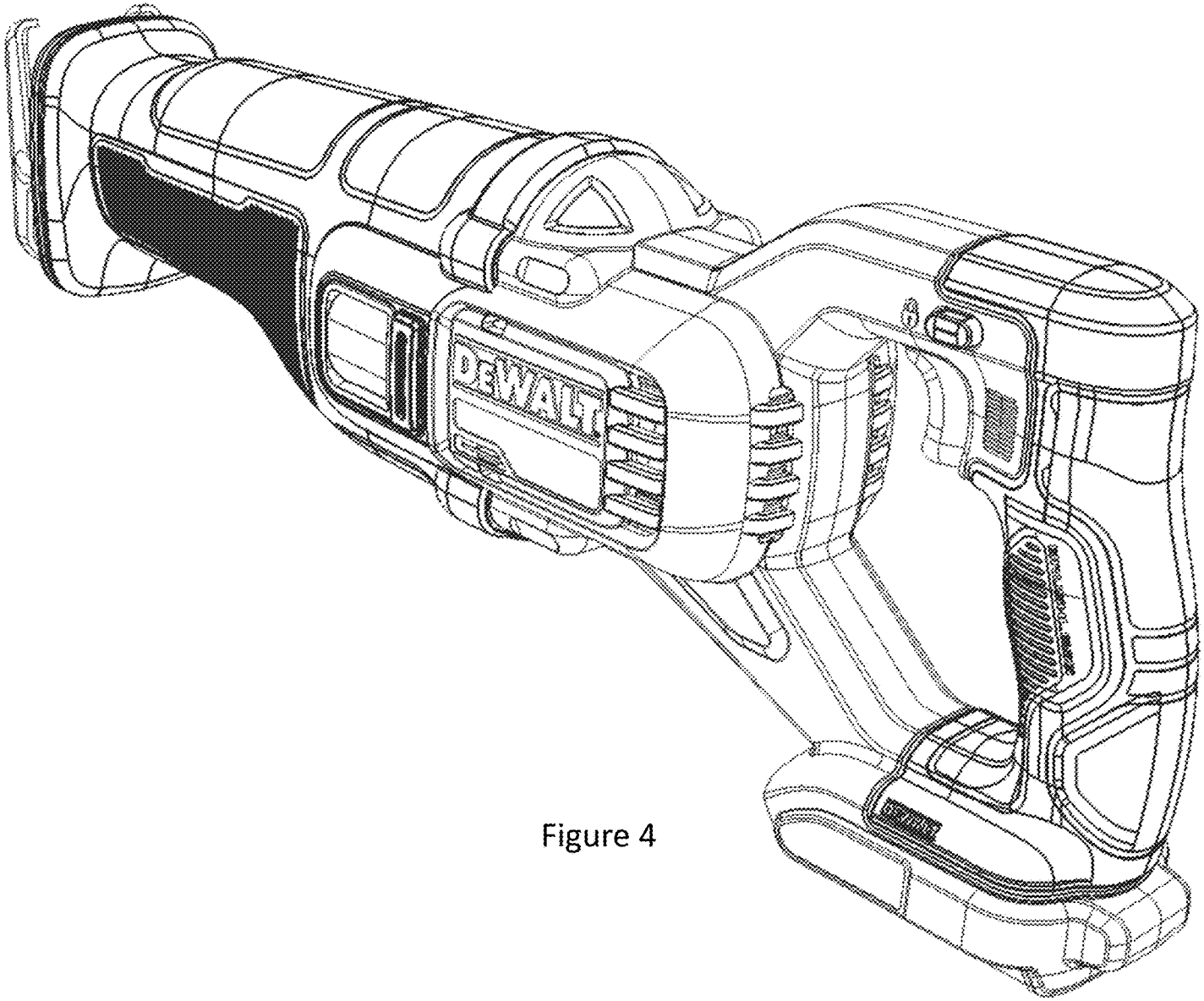
FIG. 4 is a fourth perspective view of the reciprocating saw of FIG. 1
Figure 5:
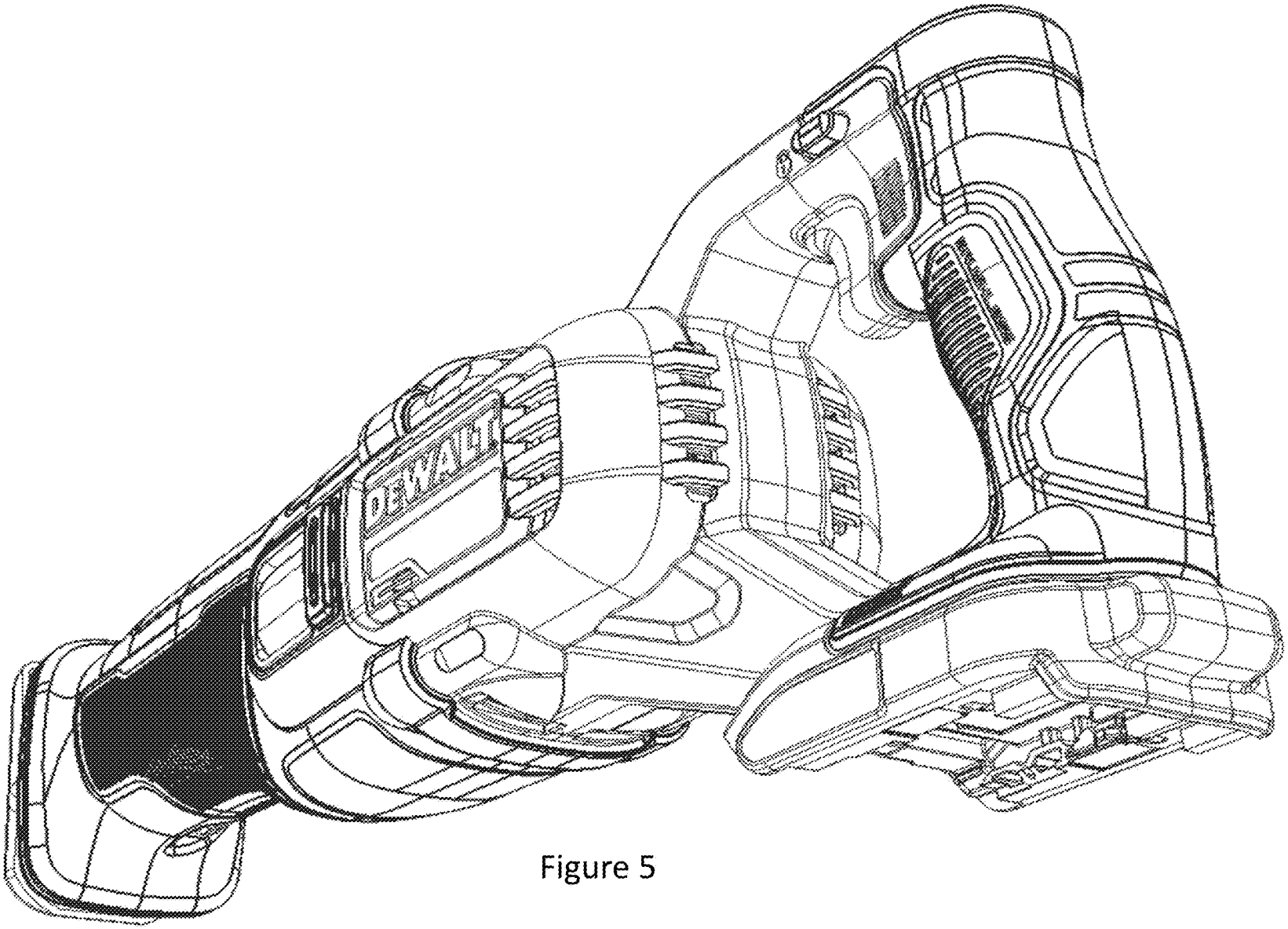
FIG. 5 is a fifth perspective view of the reciprocating saw of FIG. 1.
Figure 6:
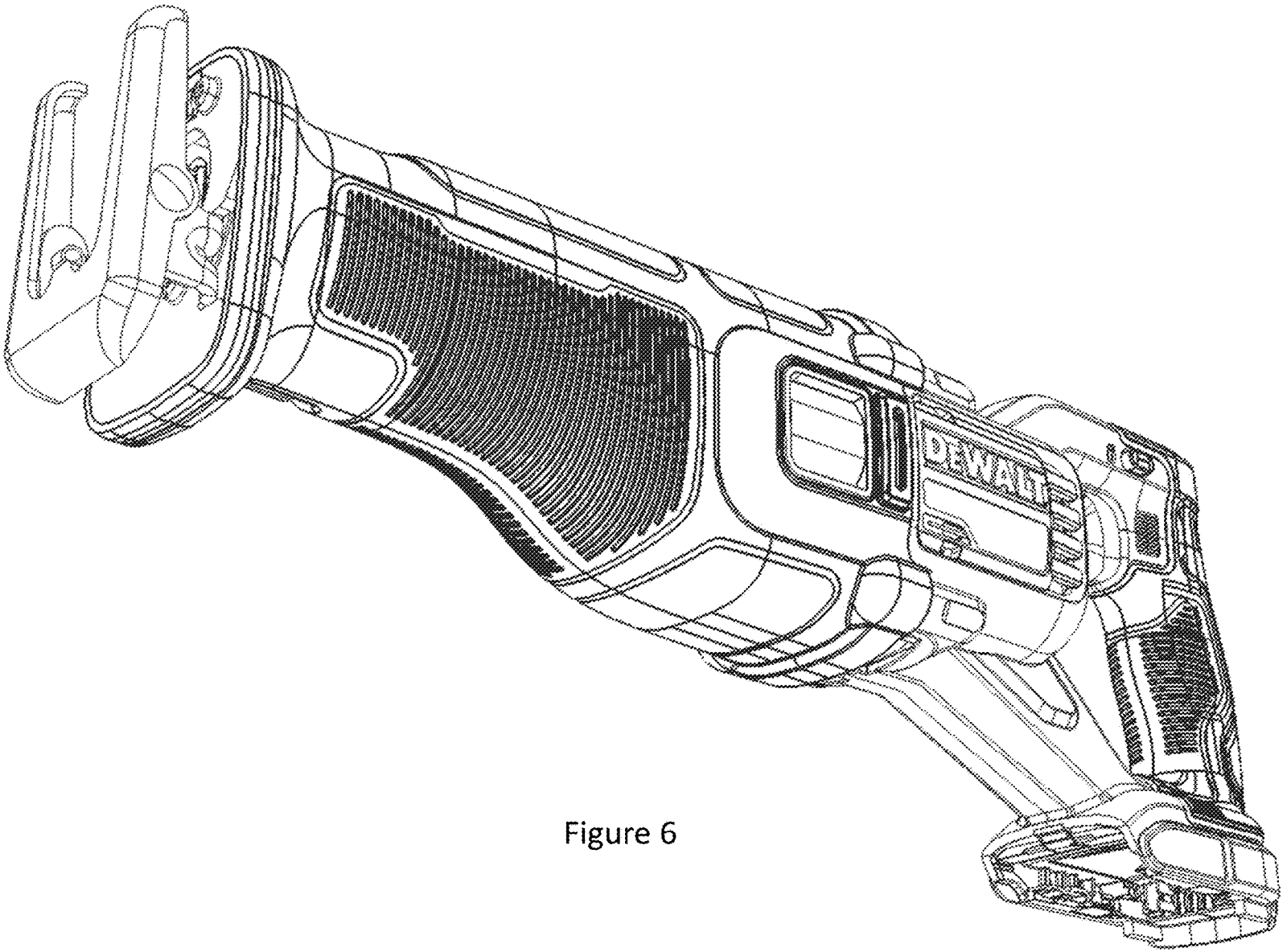
FIG. 6 is a sixth perspective view of the reciprocating saw of FIG. 1.
Figure 7:
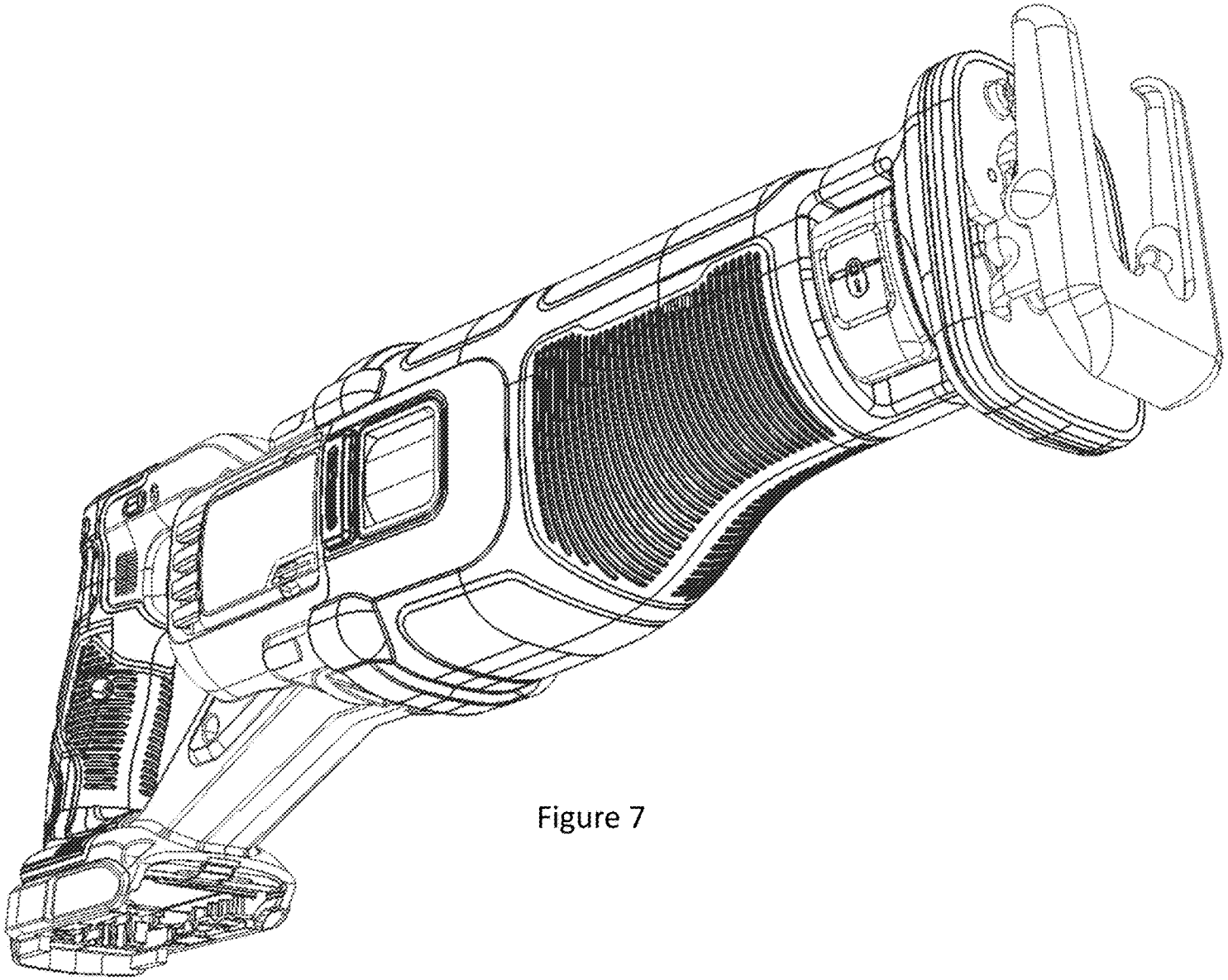
FIG. 7 is a seventh perspective view of the reciprocating saw of FIG. 1.
Figure 8:
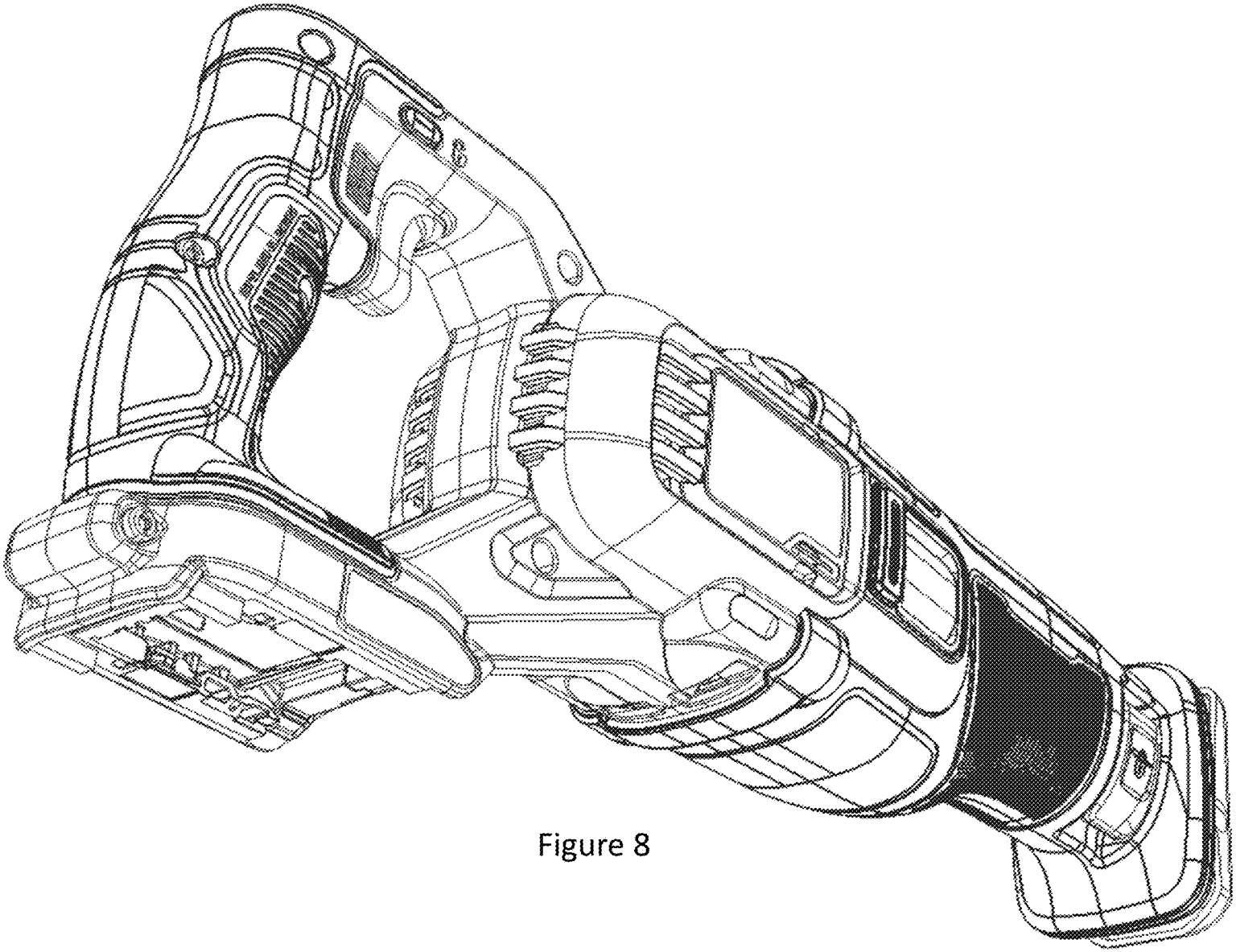
FIG. 8 is an eighth perspective view of the reciprocating saw of FIG. 1.
Figure 9:
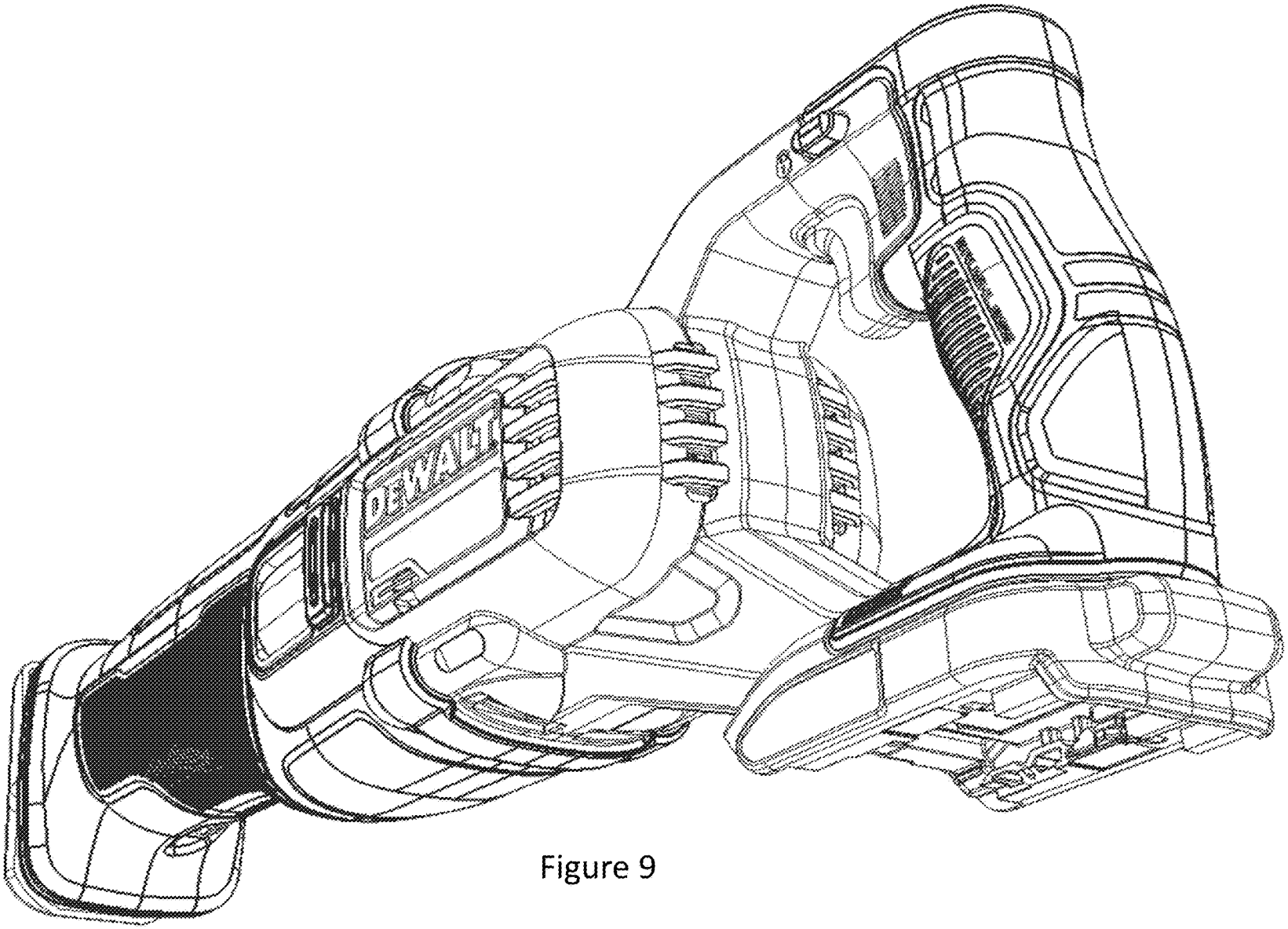
FIG. 9 is a ninth perspective view of the reciprocating saw of FIG. 1.
Figure 10:
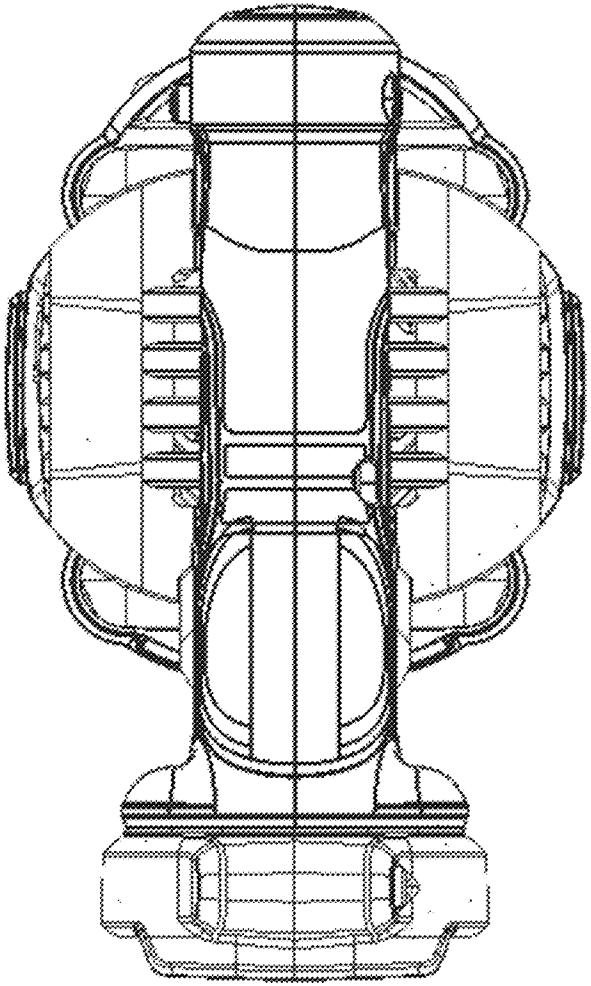
FIG. 10 is rear elevation view of the reciprocating saw of FIG. 1.
Figure 11:
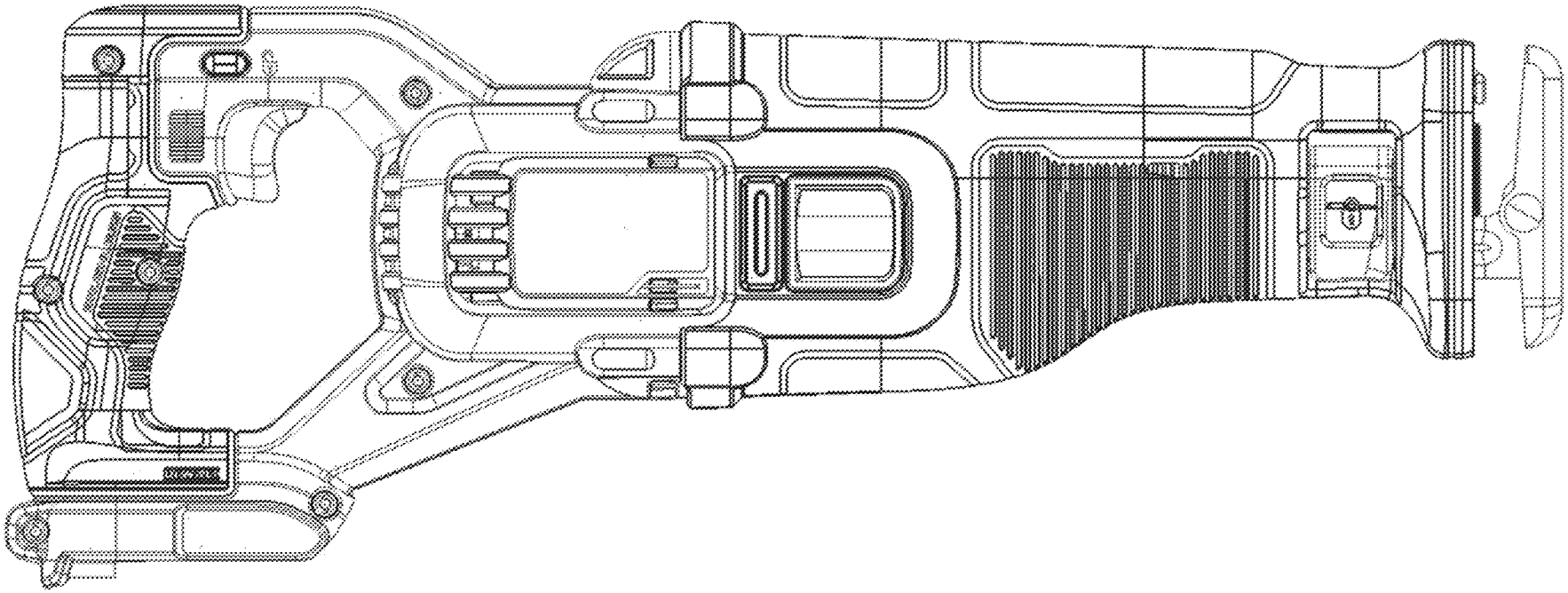
FIG. 11 is a first side elevation view of the reciprocating saw of FIG. 1.
Figure 12:
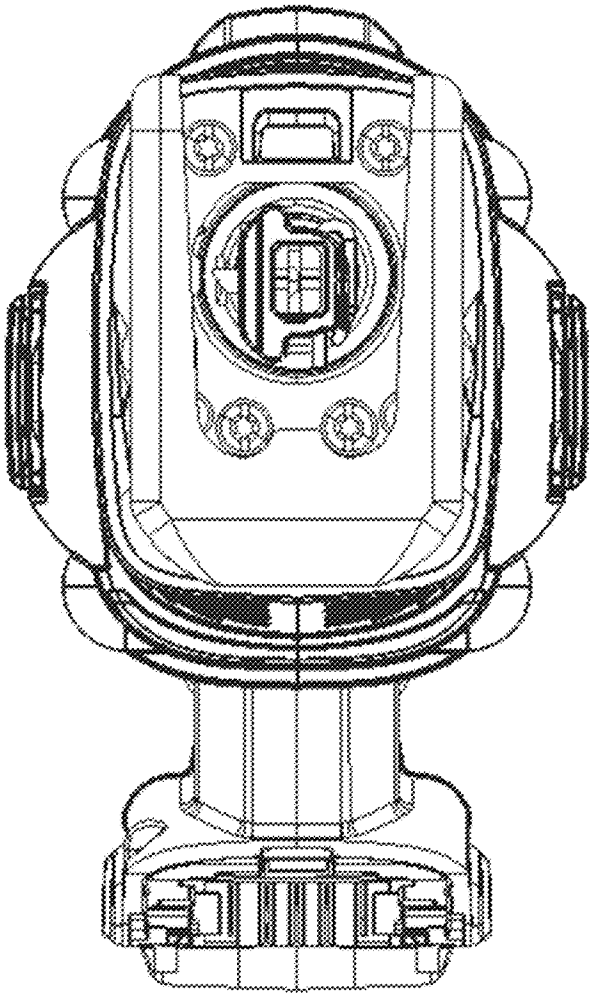
FIG. 12 is a front elevation view of the reciprocating saw of FIG. 1.
Figure 13:
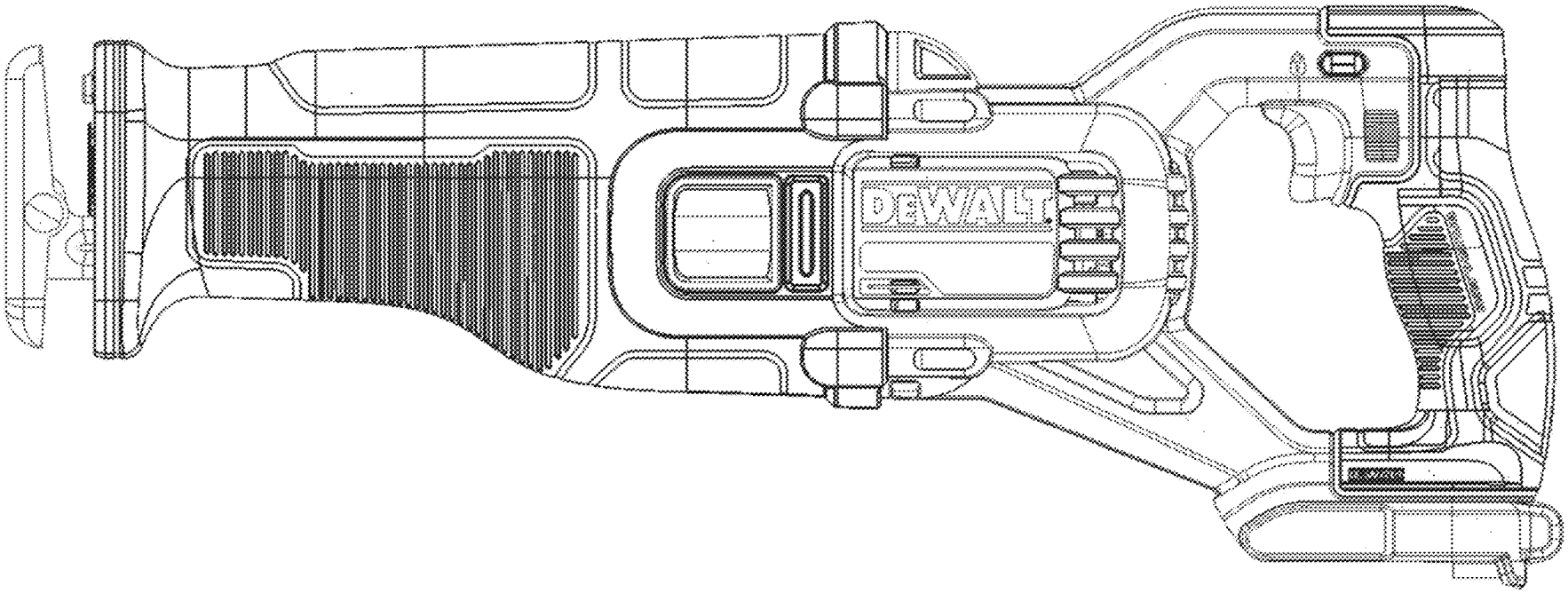
FIG. 13 is a second side elevation view of the reciprocating saw of FIG. 1.
Figure 14:
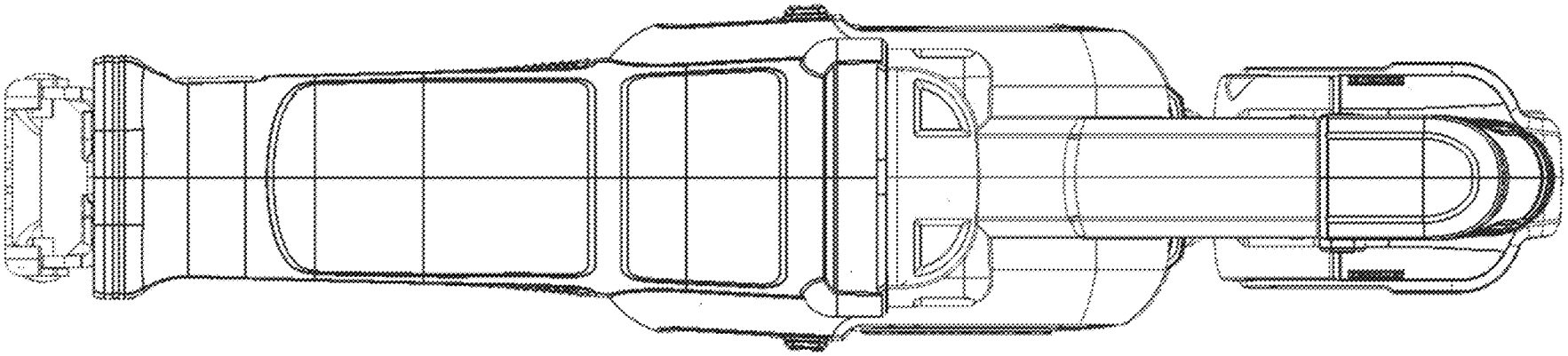
FIG. 14 is a top plan view of the reciprocating saw of FIG. 1.
Figure 15:
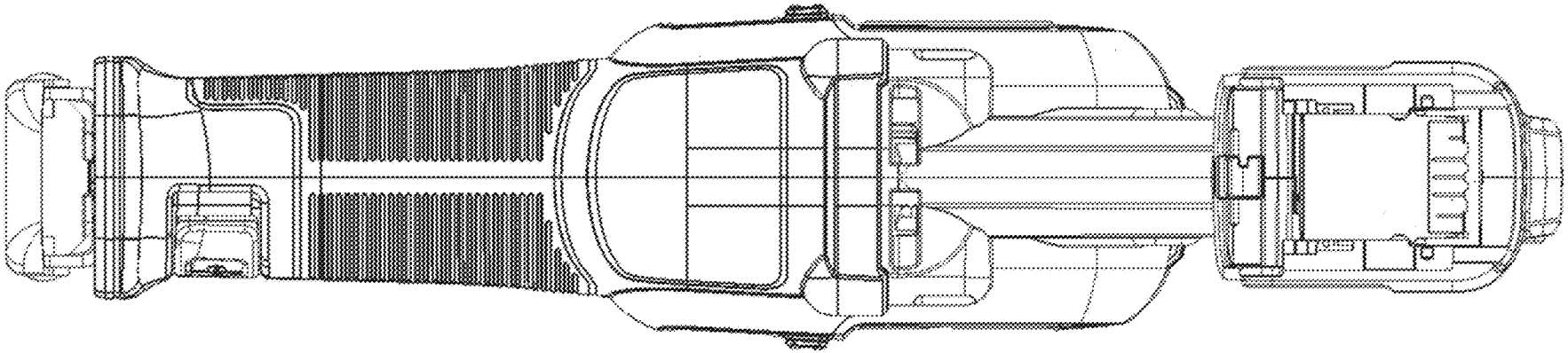
FIG. 15 is a bottom plan view of the reciprocating saw of FIG. 1.
Figure 18:
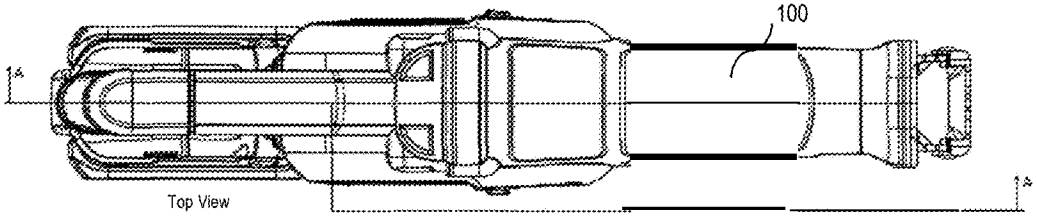
FIG. 18 is a top plan view of the reciprocating saw and battery pack of FIG. 16.

FIGS. 1 through 15 illustrate an exemplary embodiment of a new and improved reciprocating saw 100 of the present disclosure.

FIGS. 16 through 21 illustrate an exemplary embodiment of a new and improved reciprocating 100 saw coupled to a battery pack 102. The reciprocating saw 100 and the battery pack 102 include a cooperating mating interface that enables the battery pack 102 to electromechanically mate with the reciprocating saw 100. Mating interfaces in general in the cordless power tool industry for coupling a battery pack to a power tool are well known. An exemplary mating interface is illustrated and described in U.S. patent application Ser. No. 15/414,720, filed Jan. 25, 2017, which is incorporated herein by reference.

Figure 19:
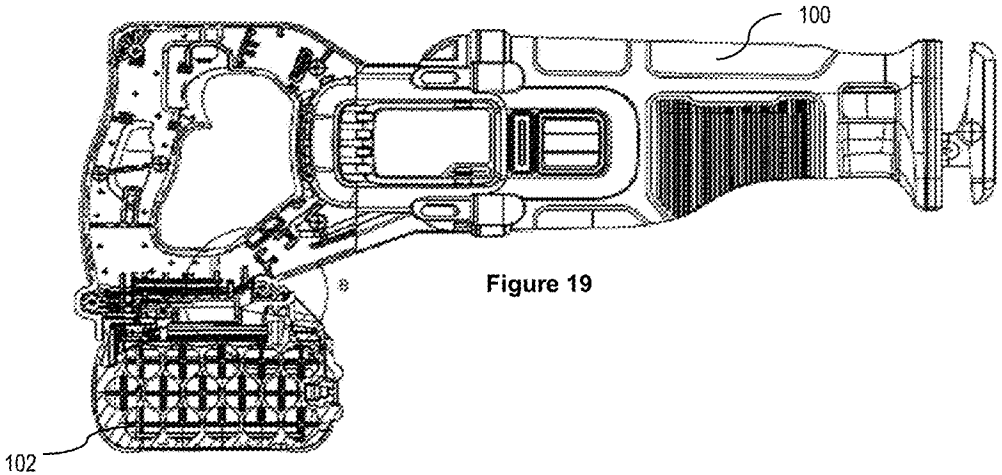
FIG. 19 is a section view along section line A-A of FIG. 18.
Figure 21:
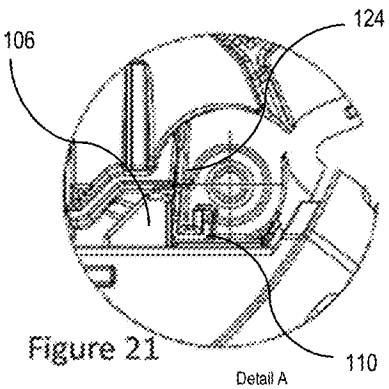
FIG. 21 is a detail view of the reciprocating saw and battery pack of FIG. 20.
Figure 20:
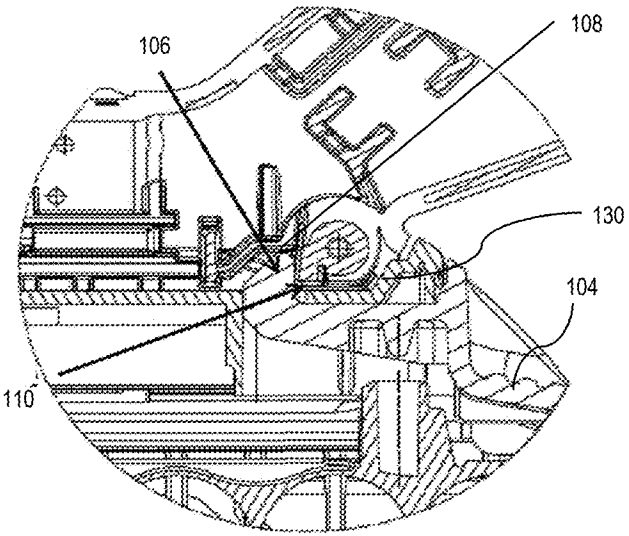
FIG. 20 is a detail view of the reciprocating saw and battery pack of FIG. 19.
Figure 23:
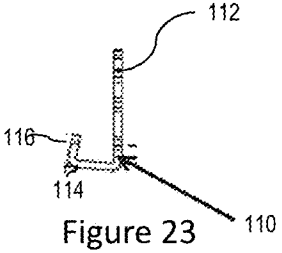
FIG. 23 is a side view of the strike plate of FIG. 22.
Figure 22:
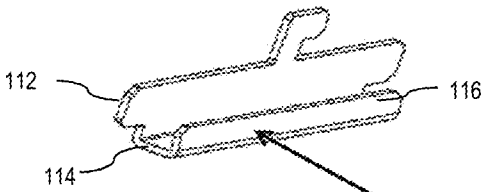
FIG. 22 is a perspective view of a strike plate of the present disclosure.

In the exemplary embodiment illustrated in FIGS. 16 and 19, the battery pack 102 is moved in a mating direction (arrow A) to couple with the reciprocating saw 100. The battery pack 102 includes a coupling button 104 and a latch 106. The saw 100 includes a catch 108 (typically in the form of a recess or a cavity) that receives the latch 106 when the battery pack 102 is fully seated or engaged with the saw 100. Upon sliding the battery pack 102 into engagement with the saw 100 (in direction A), a user could either depress the button 104 (downward) which in turn moves the latch 106 downward and allows the latch 106 to move past a forward shoulder 130 of the saw into the catch 108 or the simply slide the battery pack into engagement with the saw 100 and allow the shoulder 130 to force the latch 106 downward as the battery pack 102 slides into engagement and then allows the latch 106 to be received in the catch 108 when the battery pack 102 is fully seated with the saw 100.

In conventional systems, the battery pack latch includes a forward facing surface and the saw catch includes a rearward facing surface and upon full engagement of the battery pack and the saw the forward facing surface of the latch would abut the rearward facing surface of the catch to frictionally hold the battery pack on the saw. As noted above, during operation a reciprocating saw creates significant vibrational forces. In the configuration of the present reciprocating saw, a significant portion of the vibrational forces are in a direction opposite to the insertion direction A. As such, it is not uncommon for the latch to slide down rearward facing surface of the catch allowing the battery pack to eject from the saw.

Figure 24:
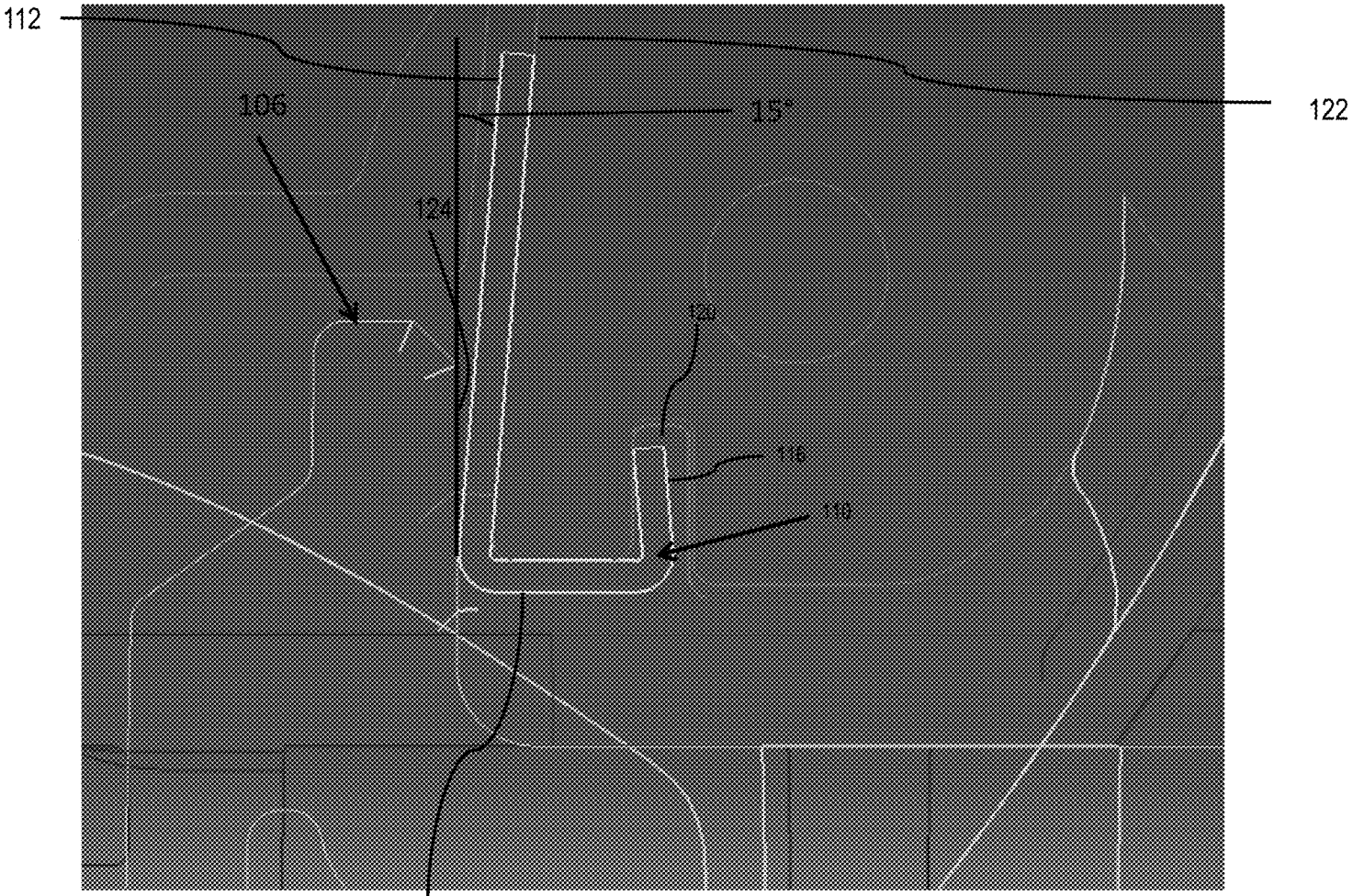
FIG. 24 is another detail view of the reciprocating saw and battery pack of FIG. 19.
Figure 25:
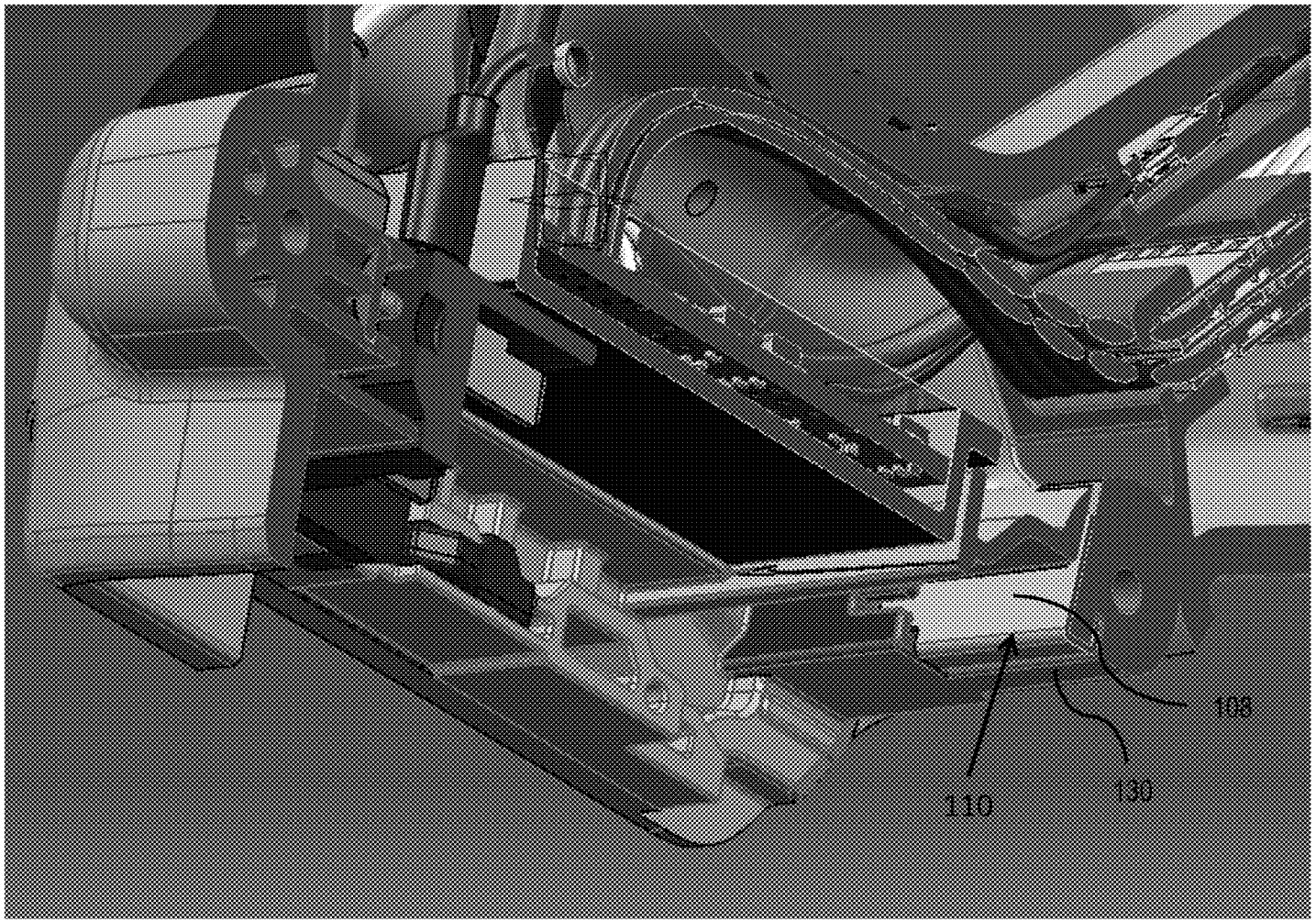
FIG. 25 is a perspective partial section view of the reciprocating saw of FIG. 6.

To address this ejection issue, the saw 102 includes a strike plate 110. The strike plate 110 is attached to the rearward facing surface 122 of the catch 108. In the exemplary embodiment disclosed in FIGS. 19-25, the strike plate 110 is in the form of a J (illustrated backwards in FIGS. 20 and 24). The strike plate 110 includes an engagement arm 112 having an engagement surface, a connecting arm 114, and a catch arm 116. The engagement arm 112 is positioned in the cavity of the catch 108 and abuts the rearward facing surface 122 of the catch 108. The engagement surface of the engagement arm 112 abuts the forward facing surface 124 of the latch 106 when the battery pack 102 is fully seated. The catch arm 116 is received in a small cavity or recess 120 in the saw to hold the strike plate 110 in place. The connecting arm 114 connects the engagement arm 112 and the catch arm 116.

In a preferred embodiment, the engagement arm 112 is at an angle of 85 degrees from the connecting arm 114. Alternatively, the engagement arm 112 is at an angle of 85 degrees to the insertion direction A. Alternatively, the engagement arm 112 is at an angle of 15 degrees to the rearward facing surface 124 of the catch 106. These angles prevent the latch 106 from sliding downward along the rearward facing surface 122 of the catch 108.

In addition, the strike plate 110 having the aforementioned angles reduces wear on the battery latch 106 which would otherwise result from the sustained vibration during operation of the reciprocating saw 100.

Figure 26:
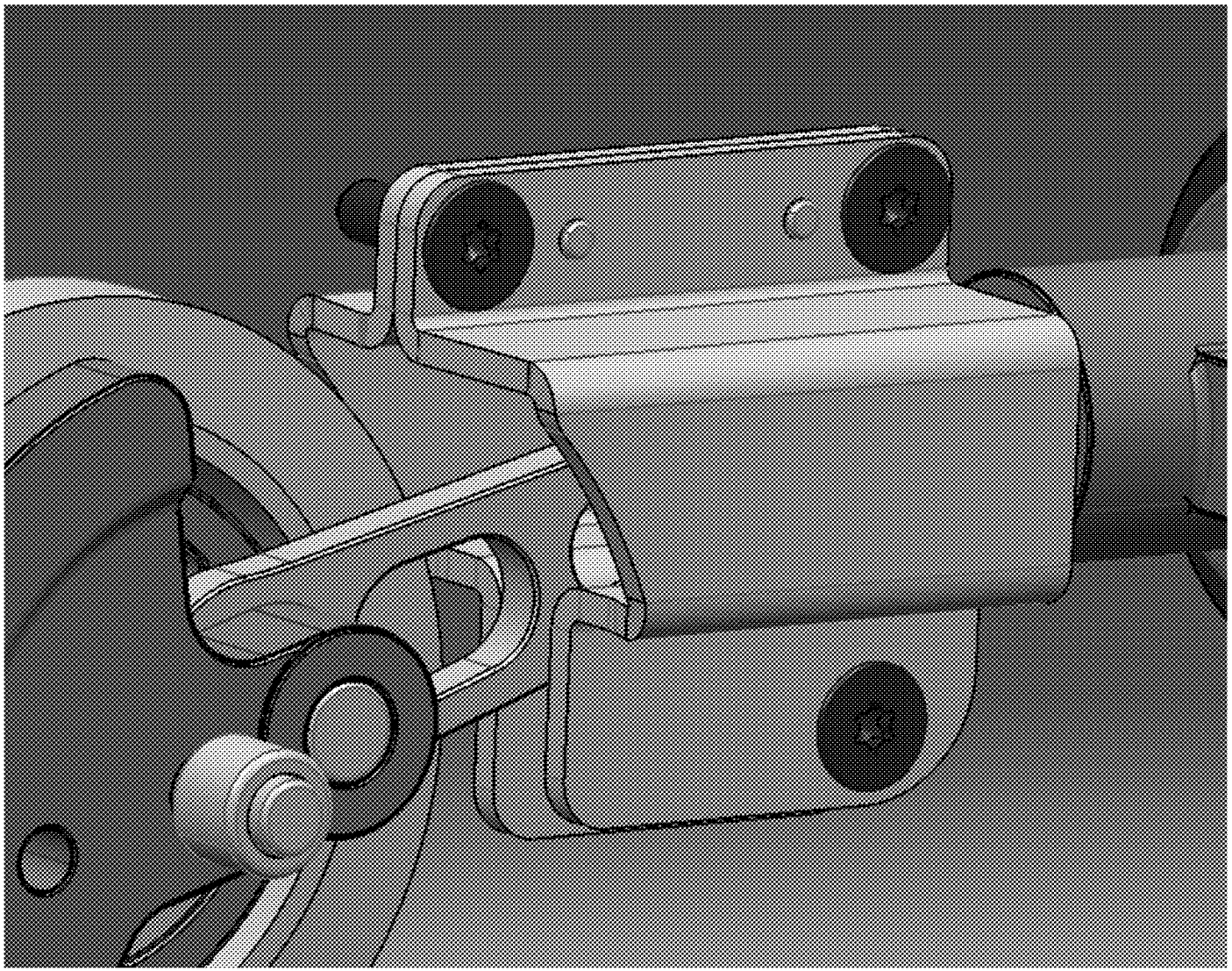
FIG. 26 is a perspective view of a guide of the reciprocating saw of FIG. 1.

FIG. 26 illustrates an exemplary embodiment of a crankshaft guide. The guide comprises two formed pieces. The guide is typically made of a metal. The first and second guide pieces include a first flange for attaching to the other piece. The first flange of each piece include at least one hole for receiving a fastener, such as a screw for connecting the two pieces. Each piece also includes a second flange. The second flange of each piece is configured to face the second flange of the other piece in a spaced, parallel relation when the two pieces are connected. The space between the two second flanges is such that the crankshaft fits therebetween. As such, a guide for the shaft is created.

This configuration enables simple manufacture of the guide, as the individual pieces are easily formed. This configuration also allows for easy repair of the saw if the guide or the crankshaft becomes damaged.

Numerous modifications may be made to the exemplary implementations described above. These and other implementations are within the scope of this application.

The invention claimed is:

1. A reciprocating saw, comprising:

a mechanical interface for receiving a battery pack including a latch having a forward facing surface, the mechanical interface including a catch for receiving the latch, the catch including a recess having a rearward facing surface; and a strike plate separate and discrete from the catch, the strike plate including an engagement arm, the engagement arm of the separate and discrete strike plate attached to the rearward facing surface of the recess to engage the forward facing surface of the latch, the engagement arm configured at an angle to the latch forward facing surface when the battery pack is fully seated in the mechanical interface.

2. The reciprocating saw, as recited in claim 1, wherein the angle to the latch forward facing surface is approximately 13 degrees to approximately 17 degrees.

3. The reciprocating saw, as recited in claim 2, wherein the angle to the latch forward facing surface is approximately 15 degrees.

4. A reciprocating saw, comprising:

a mechanical interface for receiving a battery pack including a latch having a forward facing surface, the mechanical interface including a catch for receiving the latch, the catch including a recess having a rearward facing surface; and a strike plate separate and discrete from the catch, the strike plate including an engagement arm, a connecting arm and a catch arm, the connecting arm connects the engagement arm and the catch arm, the engagement arm configured at an angle to the connecting arm, the engagement arm of the separate and discrete strike plate positioned in the cavity of the catch and abuts a forward facing surface of the catch.

5. The reciprocating saw, as recited in claim 4, wherein the engagement arm includes an engagement surface.

6. The reciprocating saw, as recited in claim 5, wherein the engagement arm abuts the latch forward facing surface when the battery pack is fully seated in the mechanical interface.

7. The reciprocating saw, as recited in claim 4, wherein the angle of the engagement arm to the connecting arm is approximately 83 degrees to approximately 87 degrees.

8. The reciprocating saw, as recited in claim 7, wherein the angle of the engagement arm to the connecting arm is approximately 85 degrees.

* * * * *